United States Patent [19]

Graziani et al.

[11] Patent Number: 4,695,364

[45] **Date of Patent: * Sep. 22, 1987**

[54] LUBE OR LIGHT DISTILLATE HYDRODEWAXING METHOD AND APPARATUS WITH LIGHT PRODUCT REMOVAL AND ENHANCED LUBE YIELDS

[75] Inventors: Kenneth R. Graziani, Woodbury; Chwan P. Kyan, Mantua; Stuart S. Shih, Cherry Hill; Raymond M. Sowiak, Haddonfield, all of N.J.

[73] Assignee: Mobil Oil Corporation, New York, N.Y.

[ * ] Notice: The portion of the term of this patent subsequent to Mar. 10, 2004 has been disclaimed.

[21] Appl. No.: 816,092

[22] Filed: Jan. 3, 1986

Related U.S. Application Data

[63] Continuation-in-part of Ser. No. 685,564, Dec. 24, 1984, Pat. No. 4,648,957.

[51] Int. Cl.[4] ..... C10G 65/02; C10G 65/12

[52] U.S. Cl. ..... 208/59; 208/71; 208/97

[58] Field of Search ..... 208/59, 58, 71, 97

[56] References Cited

U.S. PATENT DOCUMENTS

| | | | |
|---|---|---|---|
| 3,992,283 | 11/1976 | Hutchings | 208/59 |
| 4,283,271 | 8/1981 | Garwood et al. | 208/59 |
| 4,283,272 | 8/1981 | Garwood et al. | 208/59 |
| 4,347,121 | 8/1982 | Mayer et al. | 208/58 |
| 4,361,477 | 11/1982 | Miller | 208/67 |
| 4,370,219 | 1/1983 | Miller | 208/59 |
| 4,414,097 | 11/1983 | Chester et al. | 208/59 |
| 4,428,819 | 1/1984 | Shu et al. | 208/46 |
| 4,430,203 | 2/1984 | Cash | 208/210 |
| 4,478,709 | 10/1984 | Yan | 208/257 |
| 4,481,105 | 11/1984 | Chou | 208/146 |
| 4,597,854 | 7/1986 | Penick | 208/58 |
| 4,599,162 | 7/1986 | Yen | 208/59 |

*Primary Examiner*—Olik Chaudhuri

*Attorney, Agent, or Firm*—Alexander J. McKillop; Michael G. Gilman; Malcolm D. Keen

[57] ABSTRACT

An improved multistage hydrodewaxing process for hydrodewaxing a hydrocarbon feedstock, such as a heavy or light distillate, is disclosed. A two-phase mixture of a hydrogen-rich gas stream and a liquid hydrocarbon is passed through a series of spaced catalyst beds in a single reactor, reaction vapors containing olefins, are withdrawn at each interspace between beds and replaced with hydrogen-rich saturated gas.

20 Claims, 11 Drawing Figures

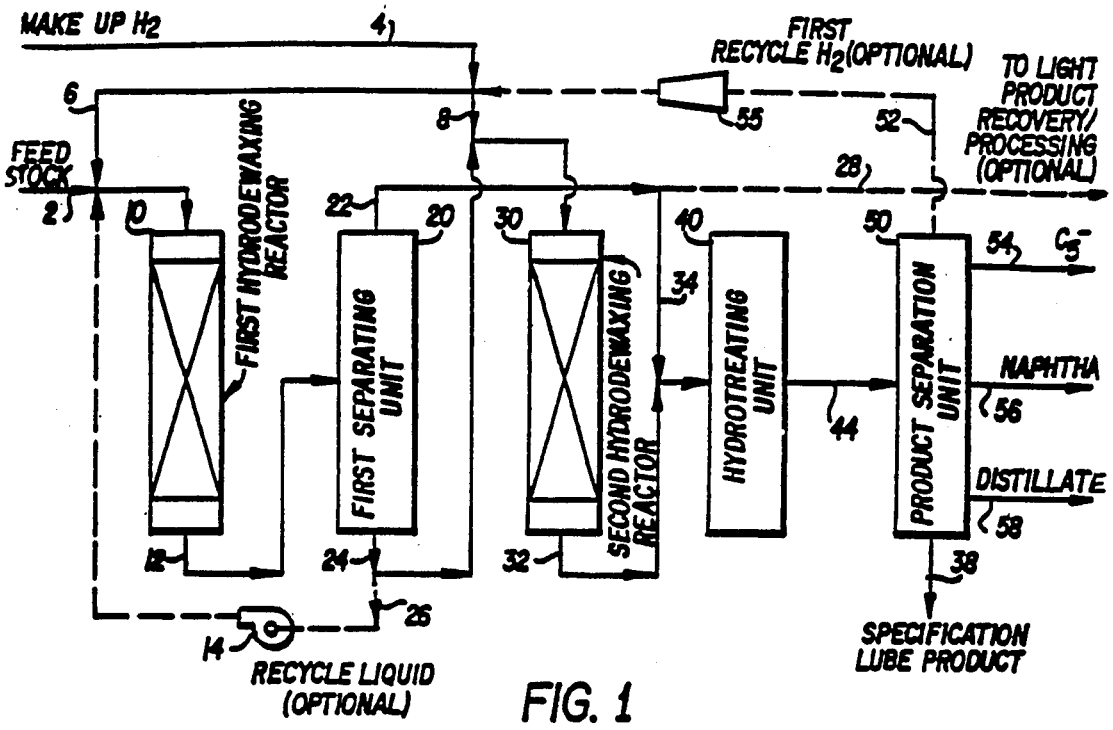
FIG. 1
FIG. 3
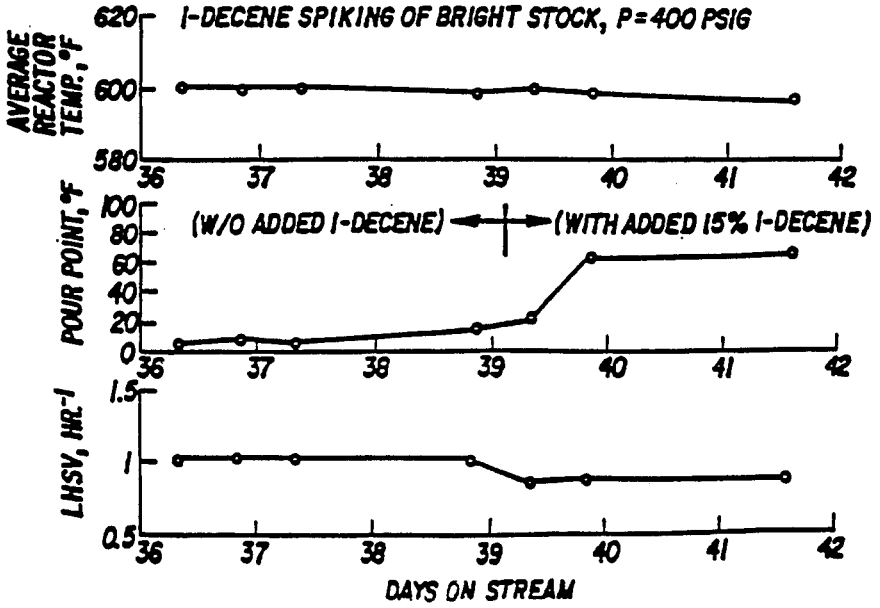

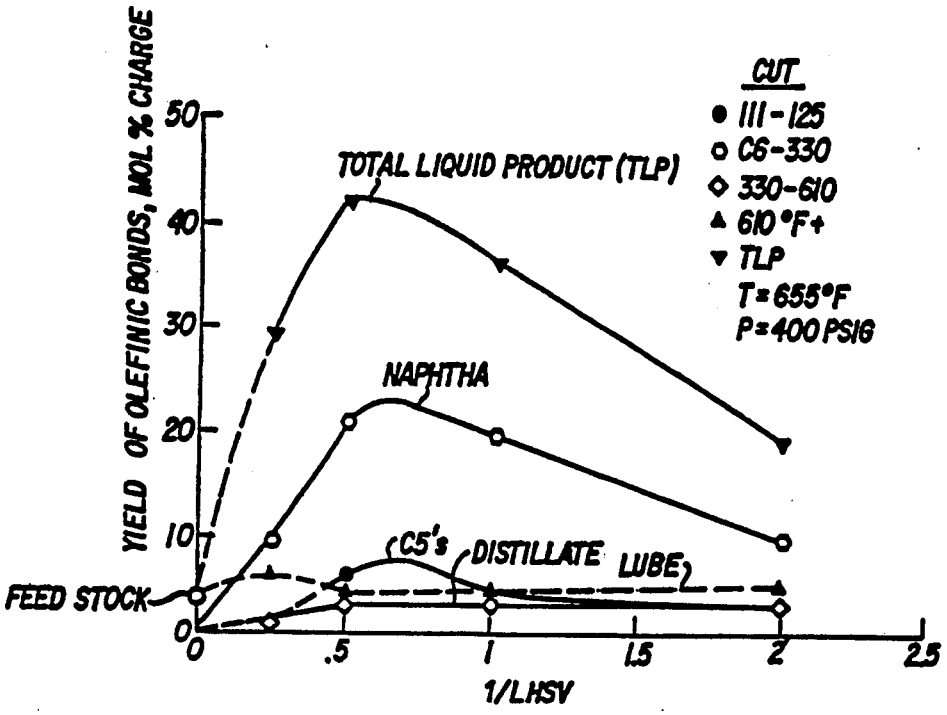
FIG. 4 OLEFINIC BOND YIELD LIGHT NEUTRAL FEEDSTOCK
FIG. 5
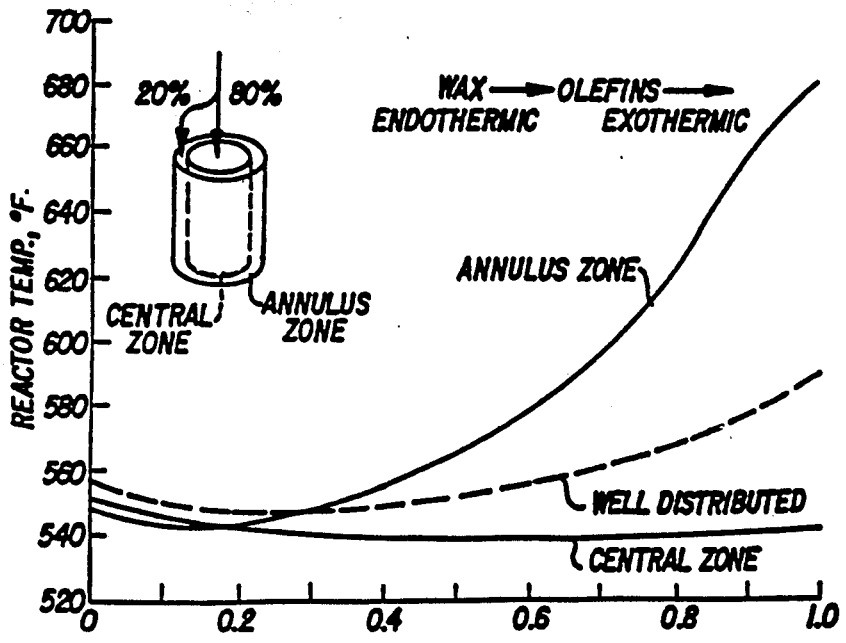

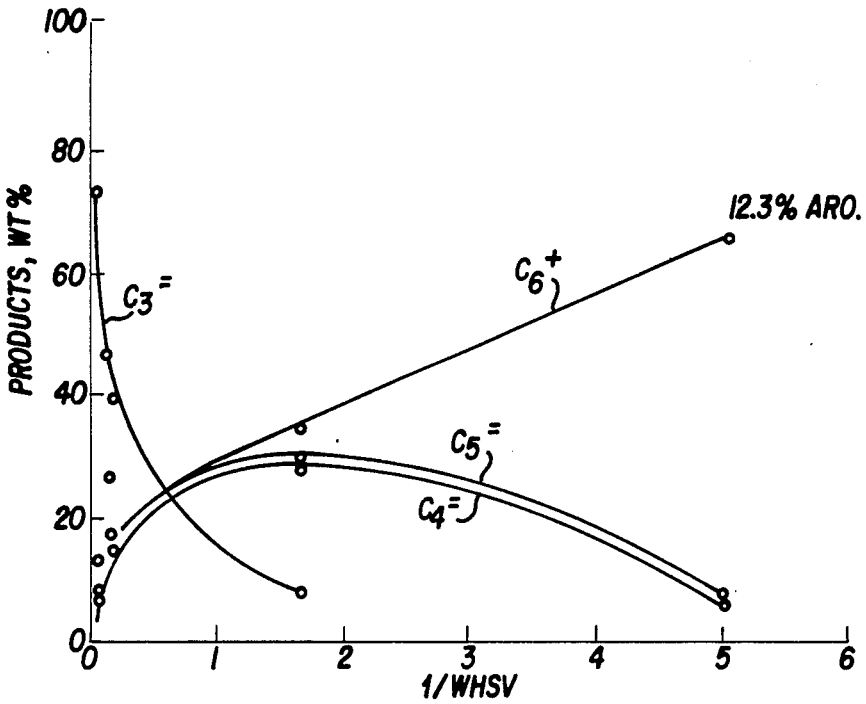
FIG. 10 PRODUCTS FROM $C_3^=$ AT 1.3 PSIA
10/1 $H_2/C_3^=$ MOLE RATIO ATMOSPHERIC PRESSURE 525°F
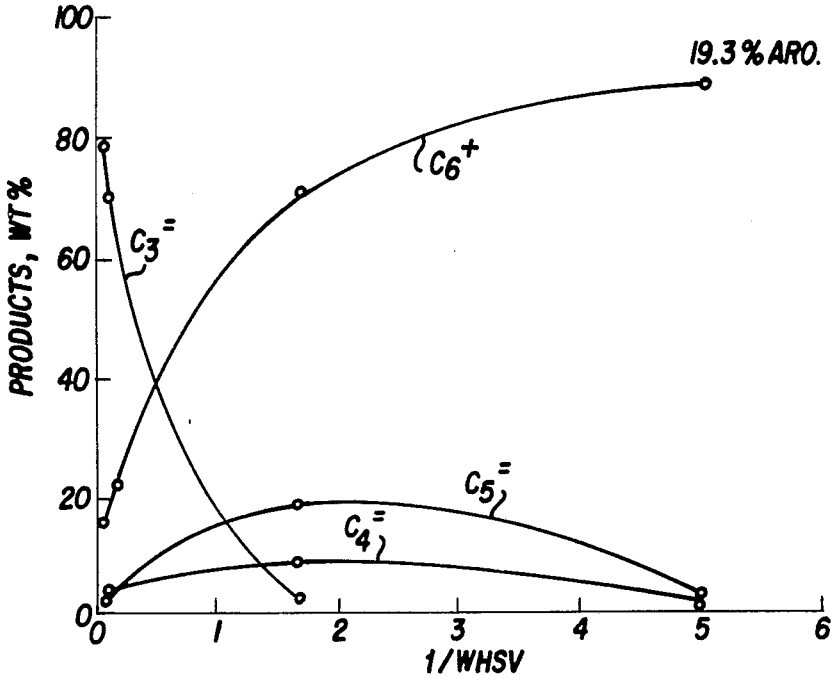
FIG. 11 PRODUCTS FROM $C_3^=$ AT 14.7 PSIA
NO DILUENT ATMOSPHERIC PRESSURE 525°F

LUBE OR LIGHT DISTILLATE HYDRODEWAXING METHOD AND APPARATUS WITH LIGHT PRODUCT REMOVAL AND ENHANCED LUBE YIELDS

RELATED PATENTS

This application is a continuation-in-part of U.S. patent application Ser. No. 685,564, filed Dec. 24, 1984, now U.S. Pat. No. 4,648,957.

BACKGROUND OF THE INVENTION

1. Field of the Invention

This invention relates to methods and apparatus for dewaxing distillate and deasphalted residual hydrocarbon liquids. More particularly, it relates to a method and apparatus for dewaxing distillate and deasphalted residual hydrocarbon liquids comprising multistage dewaxing and separation of a vapor stream between stages. It may also include catalytic oligomerization of the separated vapor stream to convert olefins in the vapor stream to gasoline, distillate and lube boiling range materials, and downstream units to hydrofinish and recover lubes.

2. Discussion of Prior Art

The dewaxing of hydrocarbons to liquids of lower pour point is a process of great commercial significance. Although alternatives exist, it is now evident that the use of shape-selective catalysts, such as ZSM-5 type catalysts, to selectively convert paraffins, which contribute the most to high pour points, to smaller chain molecules, has many advantages over other methods. Thus, catalytic dewaxing over shape-selective zeolites will likely be the most commercially significant dewaxing process in the hydrocarbon processing industry.

Catalytic dewaxing of hydrocarbon oils to reduce the temperature at which precipitation of waxy hydrocarbons occurs is a known process and is described, for example, in the Oil and Gas Journal, Jan. 6, 1975, pages 69–73. A number of patents have also described catalytic dewaxing processes. For example, U.S. Pat. No. Re. 28,398 describes a process for catalytic dewaxing with a catalyst comprising a zeolite of the ZSM-5 type and a hydrogenation/dehydrogenation component. U.S. Pat. No. 3,956,102 describes a process for hydrodewaxing a gas oil with a ZSM-5 type catalyst. U.S. Pat. No. 4,100,056 discloses that a Mordenite catalyst containing a Group VI or Group VIII metal may be used to dewax a distillate obtained from a waxy crude. U.S. Pat. No. 3,755,138 describes a process for mild solvent dewaxing to remove high quality wax from a lube stock, which is then catalytically dewaxed to specification pour point.

Catalytic dewaxing processes may be followed by other processing steps such as hydrodesulfurization and denitrogenation in order to improve the qualities of the product. For example, U.S. Pat. No 3,668,113 describes a catalytic dewaxing process employing a Mordenite dewaxing catalyst which is followed by a catalytic hydrodesulfurization step over an alumina-based catalyst. U.S. Pat. No. 4,400,265 describes a catalytic dewaxing-/hyrodewaxing process using a ZSM-5 type catalyst wherein gas oil is catalytically dewaxed followed by hydrodesulfurization in a cascade system.

In catalytic dewaxing processes using shape-selective catalysts, such as a ZSM-5 type catalyst, the waxy components, particularly the n-paraffins, are cracked by the zeolite into lighter products containing olefinic material. However, these lighter products have a boiling point (b.p.) predominantly 610° F.− (321° C.−). Olefinic fragments are unstable to oxidation; so the dewaxed oil may be subsequently hydrogenated over catalysts to saturate the olefins and improve the oxidation stability of the oil. The hydrogenation catalysts generally used are mild hydrogenation catalysts, such as a $CoMo/Al_2O_3$ type. The color of the oil may also be improved in this hydrofinishing process.

U.S. Pat. No 4,428,819 to Shu et al discloses a process for hydrofinishing a catalytically dewaxed oil in which the residual wax content of the dewaxed oil is isomerized over a hydroisomerization catalyst. Typically, heavier lube fractions (greater than 610° F. (321° C.) b.p.) contain waxy components comprising normal paraffins, branched paraffins and cyclo paraffins. When a shape-selective catalyst, such as HZSM-5, is used to dewax these feeds, the normal paraffins crack much faster than the branched paraffins and cycloparaffins. HZSM-5 is a form of ZSM-5, with only hydrogen attached to the active sites, that is, no metals added.

Experience with ZSM-5 based catalytic dewaxing has shown that the dewaxing of higher boiling point or residual feeds (greater than 610° F. b.p.) pose significantly greater problems than those experienced with lighter distillate feeds. Catalyst aging is particularly a problem for heavier feeds which cause catalysts to display a more rapid loss of activity relative to a fixed pour point specification 20° F. (e.g., −7° C.). This loss of activity results in higher aging rates (10° F./day by which the operating temperature of a dewaxing catalyst must increase to maintain desired conversion) and lower on-stream capacity factors. Loss of catalyst activity, however, is also experienced in dewaxing lighter distillate feeds.

It would be desirable to find a way to prolong hydrodewaxing catalyst activity at low cost.

Recent developments in zeolite catalysts and hydrocarbon conversion methods and apparatuses have also created interest in utilizing olefinic feedstocks for producing heavier hydrocarbons, such as $C_5+$ gasoline, distillates or lubes. These developments have contributed to the development of the Mobil olefins to gasoline/distillate (MOGD) method and apparatus, and the development of the Mobil olefins to gasoline/distillate/-lubes (MOGDL) method and apparatus.

In MOGD and MOGDL, olefins are catalytically converted to heavier hydrocarbons by catalytic oligomerization using an acid crystalline zeolite, such as a ZSM-5 type catalyst. Process conditions can be varied to favor the formation of either gasoline, distillate or lube range products. U.S. Pat. Nos. 3,960,978 and 4,021,502 to Plank et al disclose the conversion of $C_2$–$C_5$ olefins, alone or in combination with paraffinic components, into higher hydrocarbons over a crystalline zeolite catalyst. U.S. Pat. Nos. 4,150,062; 4,211,640; and 4,227,992 to Garwood et al have contributed improved processing techniques to the MOGD system. U.S. Pat. No. 4,456,781 to Marsh et al has also disclosed improved processing techniques for the MOGD system. U.S. Pat. No. 4,433,185 to Tabak teaches conversion of olefins in a two-stsge system over a ZSM-5 or ZSM-11 type zeolite catalyst to form gasoline or distillate.

Olefinic feedstocks may be obtained from various sources, including from fossil fuel processing streams, such as gas separation units, from the cracking of $C_2+$ hydrocarbons, such as LPG (liquified petroleum gas), from coal by-products and from various synthetic fuel processing streams. U.S. Pat. No. 4,100,218 to Chen et al teaches thermal cracking of ethane to ethylene, with subsequent conversion of ethylene to LPG and gasoline over a ZSM-5 type zeolite catalyst.

The conversion of olefins in a MOGDL system may occur in a gasoline mode and/or a distillate/lube mode. In the gasoline mode, the olefins are catalytically oligomerized at temperatures ranging from 400° to 800° F. and pressures ranging from 10 to 1000 psia. To avoid excessive temperatures in an exothermic reactor, the olefinic feed may be diluted. In the gasoline mode, the diluent may comprise light hydrocarbons, such as $C_3$–$C_4$, from the feedstock and/or recycled from debutanized oligomerized product. In the distillate/lube mode, olefins are catalytically oligomerized to distillate at temperatures ranging from 350° to 600° F. and pressures ranging from 100 to 3000 psig. The distillate is then upgraded by hydrotreating and separating the hydrotreated distillate to recover lubes.

Although lubes can be produced from olefins by the prior art methods, MOGDL and catalytic hydrodewaxing were not combined because the types (by b.p. distribution) of olefins in hydrodewaxed stock were not known so the hydrodewaxed stock was hydrotreated to saturate any olefins rather than recover them.

SUMMARY OF THE INVENTION

By way of background, the present inventors have now found some of the reasons why dewaxing catalysts age. Specifically, it is found that olefinic intermediates (primary by-products) which are by-products of the catalytic hydrodewaxing reaction have the following effects. The olefinic intermediates formed can undergo secondary reactions to form polynuclear aromatics, which then coke the catalyst or degrade the product quality characteristics of lubes or fuels. Secondly, the olefins themselves significantly inhibit the hydrodewaxing reaction. Third, they occur predominantly in the distillate and lighter fraction in sizeable quantity. Fourth, they can cause an uncontrolled reactor behavior, such as temperature hot spots. Fifth, they account for a major part of the catalyst deactivation.

These findings have suggested new methods and apparatuses for substantially improved hydrodewaxing of hydrocarbon feeds, which forms the present invention described below. The invention removes the olefinic intermediate products as they are formed during the course of the hydrodewaxing reaction, which prevents the formation of unwanted aromatic compounds and simultaneously enhances the hydrodewaxing catalyst activity, and also ensures a controlled reactor behavior. The enhanced activity gives a lower start-of-cycle temperature and a larger operating temperature span, thereby resulting in longer catalyst cycle life.

The invention may also remove the olefinic intermediates as they are formed during the course of the hydrodewaxing reaction and route them through a MOGDL unit to catalytically oligomerize them into additional low pour point high quality lube. Combining catalytic hydrodewaxing with MOGDL simultaneously enhances the hydrodewaxing catalyst activity, increases the lube yield and ensures a controlled reactor behavior. Furthermore, blending of the low pour MOGDL lube into the main lube product stream reduces the requirement of hydrodewaxing severity to meet a given target pour point.

Prior to the present invention, it was not known that the distribution of olefins in the intermediate products placed most of the olefins in the distillate and lighter non-lube fractions so olefins were not recovered to be available for MOGDL. Rather, in the prior art, all the effluent from catalytic hydrodewaxing was fed to a hydrotreater to saturate the olefins.

Accordingly, a primary object of the invention is to provide a method and apparatus for catalytically hydrodewaxing a hydrocarbon feed using a first hydrodewaxing reactor, followed by separating the first effluent from the first reactor into a first vapor stream and a first liquid stream, and feeding the first liquid stream to a second hydrodewaxing reactor where hydrodewaxing to desired product specification is achieved.

Another object of the invention is to provide a method and apparatus for hydrodewaxing a hydrocarbon feed in a first reactor to obtain a first liquid stream having an intermediate pour point of about 30° F. to about 100° F. (−1° to 38° C.), and hydrodewaxing the first liquid stream to obtain a second liquid stream having a pour point less than about 30° F. (−1° C.).

Another object of this invention is to provide a method and apparatus for multi-stage reactor hydrodewaxing of a hydrocarbon feed with separation of an effluent from each reactor into a liquid stream and a vapor stream and catalytically oligomerizing olefins in the vapor stream in an MOGDL unit to obtain a lube stream.

Another object of this invention is to provide a method and apparatus for hydrodewaxing a hydrocarbon feedstock in a single reactor having spaced catalyst beds, wherein inhibitive olefinic light products are removed and fresh non-olefinic hydrogen rich gas is injected between the catalyst beds.

Another object of this invention is to provide a method and apparatus for multi-stage reactor hydrodewaxing of a hydrocarbon feedstock in a single reactor having spaced catalyst beds, wherein the olefinic light products are removed and catalytically oligomerized in an MOGDL unit to obtain a lube stream.

Hydrodewaxing in first and second reactors, and in a single reactor having multiple beds, as described below, occurs under conditions which include a temperature in the range from about 400° to about 800° F. (204°–427° C.), preferably about 500° to about 675° F. (260°–357° C.), a pressure in the range from about 100 to about 2000 psig (8–139 bars), preferably about 350 to about 650 psig (25–46 bars). The hydrogen feed rate to the first reactor is in the range from about 500 to about 10,000 SCF/bbl of feedstock, preferably about 1500 to about 4000 SCF/bbl. The hydrogen feed rate to the second reactor is in the range from about 500 to about 10,000 SCF/bbl of the first liquid stream, preferably about 1500 to about 4000 SCF/bbl. The overall Liquid Hourly Space Velocity (LHSV) of the first and second hydrodewaxing reactors is in the range from about 0.25 to about 4 $hr^{-1}$, preferably about 0.5 to about 1.0 $hr^{-1}$. LHSV represents ($ft^3$/hr of reactant) per ($ft^3$ of catalyst) and the reactants are the feedstock and the first liquid stream to the respective reactor.

The ratio of space velocity for hydrodewaxing the feedstock to hydrodewaxing the liquid stream which is in the range from about 1:9 to about 9:1 and preferably about 3:7 to about 7:3.

The invention may also comprise feeding vapor streams separated from the hydrodewaxing effluents to an MOGDL unit to catalytically oligomerize the olefins in the vapor stream thereby obtaining a lube stream.

Catalytic oligomerization of the olefins in the vapor streams occurs under conditions which include temperatures in the range from about 350° to about 600° F. (177°-316° C.), pressures in the range from about 100 to about 3000 psig (8-208 bars), preferably about 800 to about 2000 psig (56-139 bars), and Weight Hourly Space Velocity (WHSV) in the range from about 0.1 to about 5.0 $hr^{-1}$. WHSV represents (lb/hr of reactant) per (lb catalyst), wherein the reactants are the vapor streams. In MOGDL the olefins may contact a crystalline zeolite catalyst having a Constraint Index of about 1 to about 12.

BRIEF DESCRIPTION OF THE DRAWINGS

FIG. 1 is a block flow diagram of an embodiment of the invention showing a first hydrodewaxing reactor, a first separating unit and a second hydrodewaxing reactor;

FIG. 3 is a plot of pilot plant dewaxing data showing the inhibition effect of olefins on hydrodewaxing catalysts;

FIG. 4 is a plot of olefinic contents of the various product cuts obtained from hydrodewaxing of light neutral stock versus 1/LHSV velocity;

FIG. 5 is a plot of temperature profile in a simulated catalytic hydrodewaxing reactor versus fractional bed length demonstrating the occurrence of a reactor temperature runaway;

FIG. 10 is a plot of the formation of low molecular weight aromatic products formed from propylene versus residence time; and FIG. 11 is a plot similar to FIG. 10.

PREFERRED EMBODIMENTS OF THE INVENTION

Figure 2:
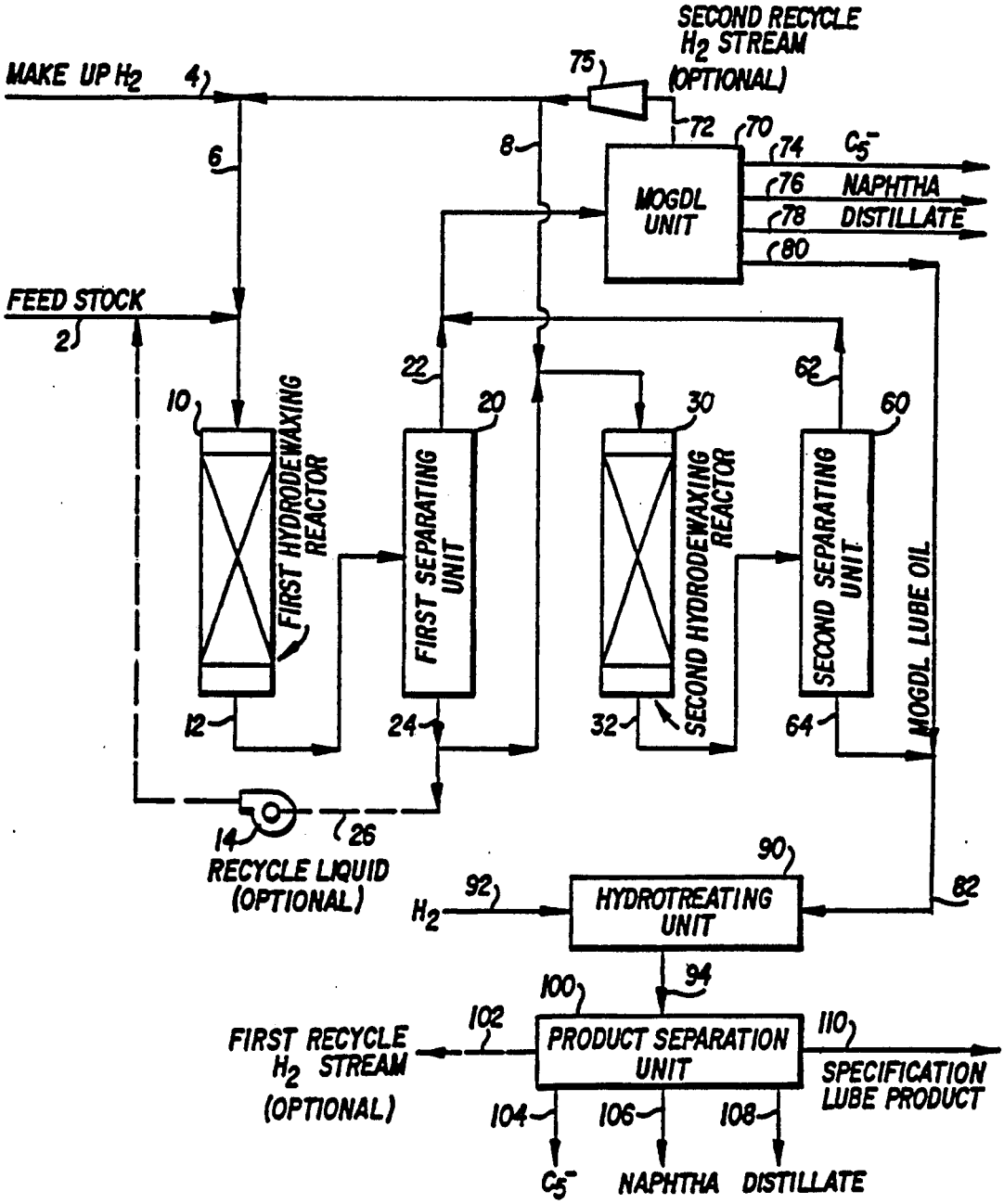
FIG. 2 shows a block flow diagram of a second embodiment of the invention showing a first hydrodewaxing reactor, a first separating unit, a second hydrodewaxing reactor, a second separating unit and a MOGDL unit.

The present process is applicable to dewaxing hydrocarbon feedstocks, including lube stocks, when a low wax content is desired in the final product. The feedstocks may comprise hydrocarbons having a 400° F.+ b.p. (boiling point), particularly those having a 610° F.+ b.p. The feeds may be virgin or prefractionated hydrocarbons.

The method of the apparatus is carried out at elevated pressure and temperature, along with suitable space velocity and hydrogen feed rates. A waxy feedstock 2, as shown in FIG. 1, with a pour point greater than about 80° F. passes through a preheater (not shown) and contacts a hydrodewaxing catalyst contained in a first hydrodewaxing reactor 10. The first hydrodewaxing reactor 10 operates at a temperature in the range from about 400° to about 800° F. (204°-427° C.), preferably about 500° to about 675° F. (260°-357° C.), a pressure from about 100 to about 2000 psig (8-139 bars), preferably about 350 to about 650 psig (25-46 bars), and a hydrogen feed rate from about 500 to about 10,000 SCF/bbl of feedstock 2, preferably about 1500 to about 4000 SCF/bbl. Hydrogen is provided to the first reactor 10 by combining a first portion 6 of make-up $H_2$ stream 4 and an optional first recycle $H_2$ stream 52 with the feedstock 2. The makeup and recycle $H_2$ streams need not be pure, but may contain minor quantities of saturated light hydrocarbons. The first hydrodewaxing reactor 10 catalytically hydrodewaxes the feedstock 2 by cracking a portion of the feedstock to obtain lighter products, such as $C_4-$ gases and light paraffinic and olefinic fragments, some of which remain in the lube oil boiling range (610° F.+ b.p.), but most of which have boiling points less than the lube oil boiling range.

A first effluent stream 12 passes from the first hydrodewaxing reactor 10 to a first separating unit 20. The separating unit 20 separates the first effluent stream 12 into a first vapor stream 22 and a first liquid stream 24. The separation is accomplished by a high pressure separator at system pressure or by lowering the pressure and flashing the first effluent stream 12 or by distilling the first effluent stream 12. The separation removes those materials boiling below 330° F., and preferably has a higher cut point of at least 610° F., depending upon the composition of the feedstock 2. For example, the typical cut points for light neutral, heavy neutral, and bright stock are 610° F., 650° F., and 800° F., respectively. Due to the catalytic hydrodewaxing of the feedstock 2, the first effluent stream 12 will have an intermediate pour point of about 30° to about 100° F. (−1° to 38° C.), preferably about 50° to about 70° F. (10°-21° C.). The composition of the first liquid stream 24 and the first vapor stream 22 can be adjusted, depending upon the final product specification desired, by adjusting the temperature and pressure in the first separating unit 20. Generally, the pour point of the first effluent stream 12 will be less than that of first liquid stream 24.

The first vapor stream 22 may be sent to downstream processing for light product recovery, while the first liquid stream 24 passes into the second hydrodewaxing reactor 30 where it contacts with catalyst. The reactor 30 operates at a temperature from about 400° to about 800° F. (204°-427° C.), preferably 500° to about 675° F. (260°-357° C.), a pressure from about 100 to about 2000 psig (8-139 bars), preferably about 350 to about 650 psig (25-46 bars), and a hydrogen feed rate from about 500 to about 10,000 SCF/bbl of the first liquid stream 24, preferably about 1500 to about 4000 SCF/bbl. Hydrogen is provided to the second reactor 30 by combining a second portion 8 of the make-up $H_2$ stream 4 and optional first recycle $H_2$ stream 52 with first liquid stream 24. The overall Liquid Hourly Space Velocity (LHSV) of the first and second hydrodewaxing reactors 10 and 30 ranges from about 0.25 to about 4 $hr^{-1}$, preferably about 0.25 to about 1.0 $hr^{-1}$. The abbreviation LHSV has units of $ft^3$/hr of reactants per $ft^3$ of catalyst in reactors 10 and 30. The reactants to the respective reactors 10 and 30 are the feedstock 2 and the first liquid stream 24. The ratio of LHSV for the reactor 10 for hydrodewaxing the feedstock to that of the reactor 30 for hydrodewaxing the liquid stream ranges from about 1:9 to about 9:1, and preferably about 3:7 to about 7:3. In both hydrodewaxing reactors 10 and 30, the hydrocarbons contact a crystalline zeolite catalyst as discussed below.

In the second hydrodewaxing reactor 30, the first liquid stream 24 is catalytically hydrodewaxed to produce a second effluent stream 32 having a pour point less than about 30° F. (−1° C.), preferably less than about 20° F. (−7° C.). The second effluent stream 32 is then hydrotreated and separated, as described below, to produce a lube product stream 38. The hydrotreating is accomplished by feeding the second effluent stream 32 and an optional stream 34 to a hydrotreating unit 40 to saturate olefins. Generally, the pour point of the second effluent stream 32 will be about the same as that of the product stream 38.

The first vapor stream 22 may either form stream 34 and be combined with second effluent stream 32 and sent to the hydrotreating unit 40, or stream 22 may be sent to light product recovery/processing (not shown) as stream 28. Stream 22 contains olefins and may be sent to the hydrotreating unit 40 as stream 34 if it is desired to saturate these olefins. However, stream 28 may be sent to light product recovery/processing if it is desired to recover or process the olefins. Hydrogen is provided to the unit 40 by stream 32 which contains unconsumed hydrogen from stream 8. Hydrotreating will be discussed in more detail below.

The streams to be upgraded are preferably stabilized by being subjected to hydrotreating to saturate olefins and diolefins contained therein and to increase the cetane value of any distillate produced. Hydrogen gas may be obtained by sources such as steam reforming. Hydrotreating is a catalytic process which preferably employs a cobalt-molybdenum or nickel-tungsten containing catalyst. Saturation of the olefinic double bond is essentially complete under hydrogenation conditions of about 500° to about 700° F. (260°–371° C.), a pressure of about 100 to about 500 psig (8–36 bars), a space velocity of about 0.5 to about 5.0 LHSV (liquid hourly space velocity), and a hydrogen feed rate of about 1000 to about 5000 SCF/bbl. Hydrotreating generally does not affect pour point of the lube product.

A hydrotreated effluent stream 44 passes to a product separation unit 50 which separates the hydrotreated effluent stream 44 into a $C_5-$ stream 54, naphtha stream 56, distillate stream 58, specification lube product 38 and optionally the first recycle hydrogen stream 52, which may pass through first recycle compressor 55 and combine with makeup hydrogen stream 4.

Another option is to separate a recycle liquid stream 26 from the first liquid stream 24. The recycle liquid stream 26 passes through a first recycle pump 14 and is combined with the feedstock 2 for recycle back to the first hydrodewaxing reactor 10. The recycle liquid stream 26 reduces the olefinic partial pressure inside the first hydrodewaxing reactor 10 and minimizes secondary olefinic reactions.

It should be understood that the first and second hydrodewaxing reactors 10 and 30 are shown as each having one reactor; however, they may each actually comprise a plurality of reactors in parallel or in series, or each may comprise a catalyst bed in the same reactor vessel. Furthermore, greater than two reactors in series with interstage separation may be employed for dewaxing.

Fixed bed reactors are suitable for this invention. However, other reactor types, such as continuous stirred tank reactors (CSTR), slurry reactors, etc., may be employed.

The advantages of the embodiment of FIG. 1 include removal of the primary reaction by-products produced during the cracking of waxes in a feedstock. It was found that the primary reaction by-products contain olefins and other light (less than 610° F. b.p. (321° C.)) products which can inhibit hydrodewaxing catalyst activity. Dewaxing is endothermic; however, hydrogenation of the olefinic gas phase is exothermic. The hydrogenation within a hydrodewaxing reactor can lead to a temperature rise of 130° F. or, in the worst case, temperature runaways. This large temperature rise would decrease the lube yield and degrade the lube product. Removing the light primary by-products, as the vapor stream from the first separating unit 20, reduces the gas phase in subsequent hydrodewaxing reactors and removes the olefins before they can hydrogenate. This provides a more controllable reactor with greatly reduced potential for temperature runaway.

FIG. 2 shows a second embodiment of the invention in which the second effluent stream 32 passes to a second separating unit 60. The second separating unit 60 operates within a similar range of operating conditions as the first separating unit 20 discussed above. The second separating unit 60 separates the second effluent stream 32 into a second vapor stream 62 and a second liquid stream 64. The separating unit 60 removes those materials boiling below 330° F., and preferably has a higher cut point of at least 610° F. The first vapor stream 22 and second vapor stream 62 are combined and pass into a MOGDL unit 70. Operating parameters for MOGDL unit 70 are described in more detail below. The streams 22, 62 contain a high proportion of light (less than 610° F. b.p. (321° C.)) olefins which are converted in the MOGDL unit 70 by catalytic oligmerization to form heavier hydrocarbons, which include lube range hydrocarbons. MOGDL unit 70 also contains separation facilities to separate the product of catalytic oligmerization into a second $C_5-$ stream 74, a second naphtha stream 76, a second distillate stream 78, a MOGDL lube oil stream 80 and, optionally, a second recycle hydrogen stream 72. The second recycle hydrogen stream 72 may be compressed by second recycle compressor 75 and combined with makeup hydrogen stream 4 for recycle to the first and second hydrodewaxing reactors 10, 30. MOGDL lube oil stream 80 may be combined with the second liquid stream 64 to form combined stream 82, which passes to hydrotreating unit 90 where it is combined with hydrogen provided by a hydrogen stream 92 to form hydrotreating effluent stream 94. Stream 94 passes to product separation unit 100, where it is separated into a first $C_5-$ stream 104, a first naphtha stream 106, a first distillate stream 108, a specification lube product stream 110 and, optionally, a first recycle hydrogen stream 102 which may be combined with make-up hydrogen stream 4.

General operating parameters for production of lube boiling range materials (610° F.+ b.p. (321° C.)) in the MOGDL unit 70 include pressures from about 100 to about 3000 psig (8–208 bars), preferably about 800 to about 2000 psig (56–139 bars), temperatures ranging from about 350°0 to about 600° F. (177°–316° C.), and Weight Hourly Space Velocities of about 0.1 to about 5 WHSV. WHSV represents (lbs reactants/hr) per (lb catalyst). Conversion of olefins to heavier products, such as distillates, is typically greater than 90%. A suitable system for conversion of olefins to heavier hydrocarbons and upgrading of the heavier hydrocarbons by hydrotreating and separation to recover lube oil is described in more detail in U.S. Pat. No. 4,413,153 (Garwood et al).

The advantages of the second embodiment include enhanced dewaxing catalyst activity and slower catalyst aging rate due to a lower light olefin partial pressure. A less severe dewaxing is required to meet the same target pour point due to the effect of blending low pour MOGDL lube product and the main lube product. A longer dewaxing catalyst cycle length is accomplished due to the lower start of cycle temperature and therefore greater operating temperature span resulting from the less severe dewaxing requirements. The less severe dewaxing requirements result in a higher lube yield for the same target pour point. Lowering the olefin partial pressure results in a more controllable reactor with reduced potential of temperature runaway. In addition, hydrogen requirements are reduced for subsequent lube hydrotreating because olefinic light material is removed prior to the hydrotreating.

Figure 7:
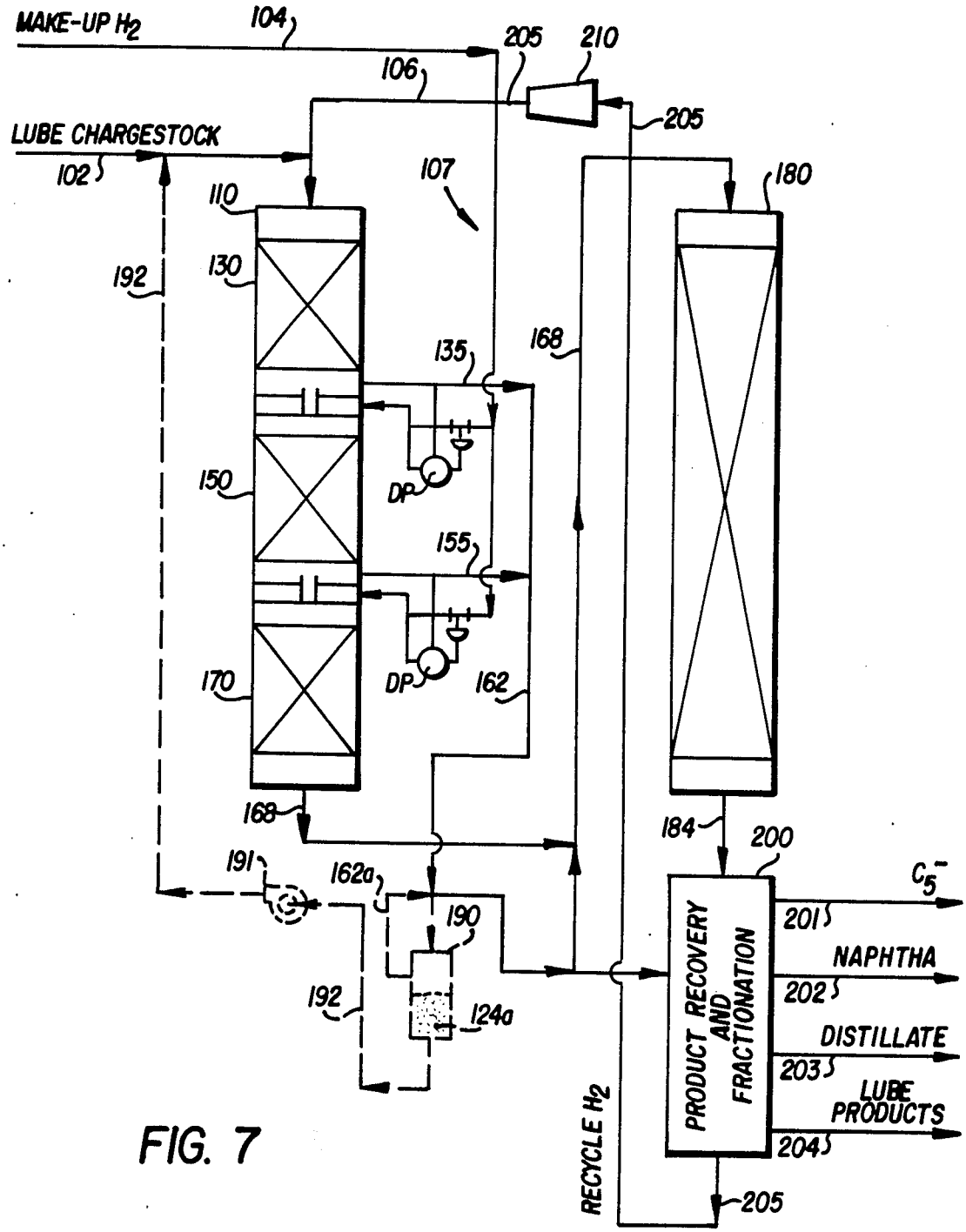
FIG. 7 is a block flow diagram of a third embodiment of the invention, showing a single dewaxing reactor having spaced catalyst beds, in combination with a hydrotreater.

In another embodiment of the invention, a waxy hydrocarbon feedstock is dewaxed in a single catalytic dewaxing reactor, as shown in FIG. 7. The use of a single reactor not only provides for the advantage in removing light olefins, as discussed above, but will reduce capital costs and allows for the easy retrofitting of existing dewaxing reactors. The reactor is composed of a series of spaced adjacent catalyst beds. Each of the beds are separated by a first space, a solid collector tray with one or more downcomers, a second space and a perforated distributor tray having a plurality of weirs. As the feedstock is dewaxed, olefin containing vapors produced are withdrawn from the space between a catalyst bed and a collector tray. Hydrogen rich gas is simultaneously injected into the space between the collector tray and the distributor tray. Such olefin withdrawal and hydrogen replacement reduces the concentration of olefins to improve the overall dewaxing process.

Figure 8:
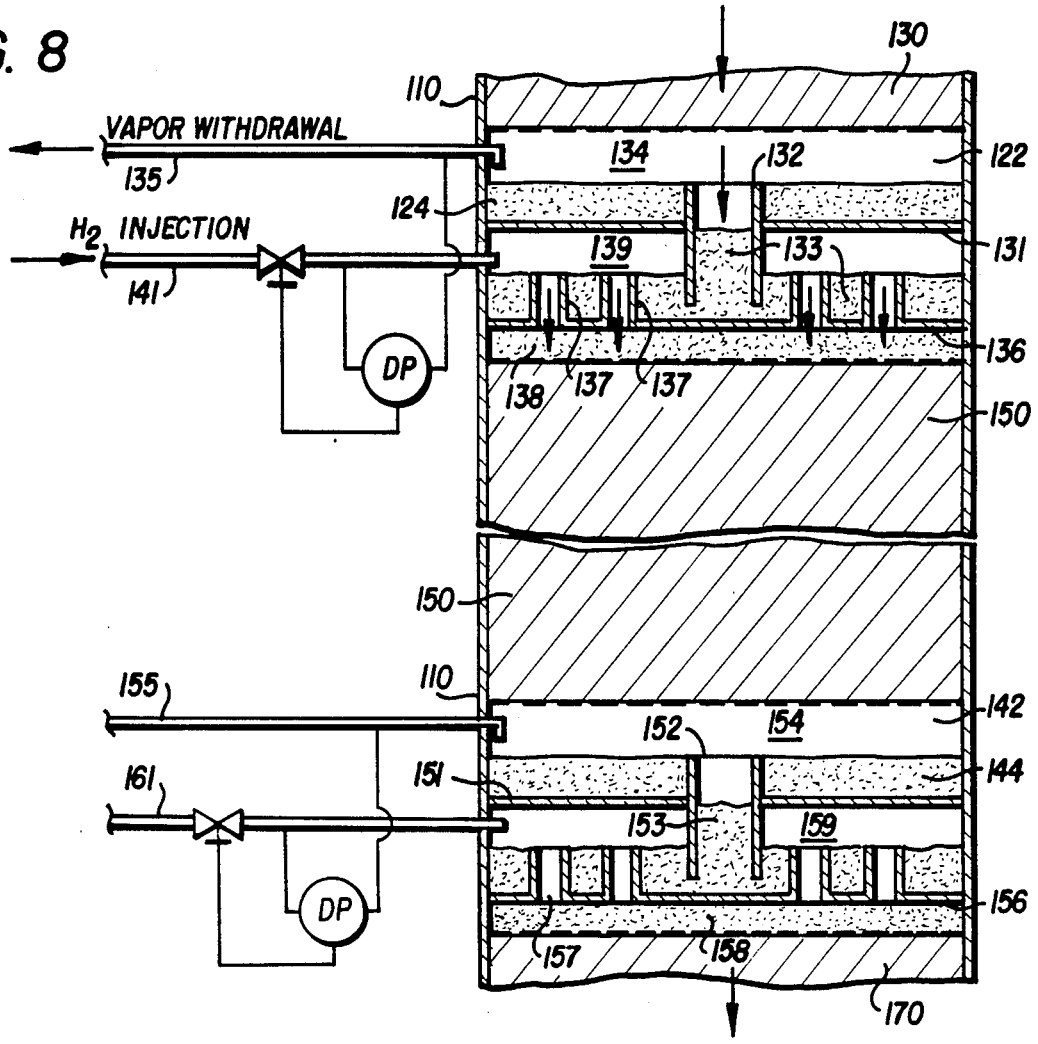
FIG. 8 is a magnified view of a portion of the dewaxing reactor of FIG. 7.

With reference to FIGS. 7 and 8, a waxy hydrocarbon feedstock 102, having an initial pour point of greater than 80° F. (27° C.), and an end point of greater than 610° F. (321° C.) passes through a pre-heater (not shown) and is conveyed to the top of a dewaxing reactor 110 having spaced catalyst beds 130, 150 and 170. However, the number of beds is not limited to three and the feedstock is not limited to lube-type feeds. The reactor and method of this invention can be practiced by introducing waxy non-lube feeds with end points less than 610° F. (321° C.) to the reactor 110. The reactor 110 operates at a temperature in the range from about 400° to about 800° F. (204°–427° C.), preferably about 500° to about 675° F. (260°–357° C.), a pressure from about 100 to about 2000 psig (8–139 bars), preferably about 350 to about 650 psig (25–46 bars), and a hydrogen feed rate from about 500 to about 10,000 SCF/bbl of feedstock 102, preferably about 1500 to about 4000 SCF/bbl. Hydrogen is provided to the top of the reactor 110 by either injecting fresh make-up hydrogen 104 or combining make-up hydrogen with recycle hydrogen 205, which creates hydrogen stream 106. The feedstock 102 and hydrogen stream 104 or 106 contact a first catalyst bed 130, preferably containing a dewaxing catalyst, such as a catalyst of the structure of ZSM-5 containing a Ni or Pd component or other catalysts, as more fully discussed below. Under the conditions described above, the feedstock is catalytically dewaxed, producing a first treated liquid feedstock 124 and a first quantity of vapor 122. Treated liquid feedstock 124 will have a reduced pour point. The vapor stream is composed of light gases, such as $C_1$–$C_4$ gases, and light parafinic and olefinic fragments, some of which remain in the lube oil boiling range (610° F.+ b.p.), but most of which have boiling points less than the lube oil boiling range. Additionally, the vapor stream may contain a fraction from the front end of the treated feedstock boiling around 610° F.

The first quantity of vapor 122 and the treated liquid feedstock 124 are passed from the first catalyst bed 130 to a first collector tray 131 having at least one downcomer 132. The treated feedstock 124 rises to the level of the downcomer 132 and is passed through the downcomer 132 as collector tray effluent 133. As the treated feedstock 124 is passed to the collector tray 131, the vapor 122 collects in a first space 134 positioned between catalyst bed 130 and collector tray 131. Vapor 122 is withdrawn as a vapor stream via vapor removal pipe 135 and may be combined with the vapor from vapor removal pipe 155 to form combined vapor stream 162. The withdrawn vapor phase can be fed to a hydrotreating unit 180 or sent to product recovery unit 200. Alternatively, the withdrawn vapor may be sent to an MOGDL unit (not shown) to convert the vapor to a lube product as discussed in embodiment two. In withdrawing vapor from between the catalyst bed 130 and the collector tray 131, a portion of the treated feedstock 124 may be entrained. This portion may be composed of a small amount of low pour, high viscosity product and is a fraction from the front end of the treated feedstock. Where feedstock 102 is a waxy heavy distillate, such as bright stock, the removed treated feedstock **124*a* will not have a pour point of specification and is recycled to the top of the reactor 110. Where the treated removed feedstock 124*a* is not of specification, it is conveyed to optional separator 190. Separation of the removed treated feedstock and olefins is accomplished by a high pressure separator or by a flashing unit. The removed feedstock is recycled via recycle pump 191 and line 192 to the top of the reactor 110 and the first catalyst bed 130. The treated feedstock may also be charged into any one of the other catalyst beds shown in reactor 110. The separated olefin stream can be conveyed as stream 162*a* back to stream 162 via 168. Where the removed treated feedstock 124*a* is of specification, i.e., it has a pour point less than 20° F. (−7° C.), it can be sent to hydrotreater 180**. In such a case, there is no need to separate olefin containing vapors from the stream.

The collector tray effluent 133 is passed to a perforated distributor tray 136 having a plurality of tube weirs 137. The effluent 133 rises to the level of the weirs and is passed through the weirs as distributor tray effluent 138. In a space 139, located between the first collector tray 133 and the first distributor tray 136, hydrogen-rich gas is injected by means 141. Fresh gas is introduced to the reactor to provide adequate $H_2$ flow to the next bed, to maintain system pressure and to have an adequate liquid seal level inside downcomer 133. The hydrogen-rich gas can be supplied by makeup hydrogen-rich stream 104 or combined with stream 104 and 205, forming stream 107. This gas can be heat-exchanged with the withdrawn vapor 122 so that the hydrogen-rich gas is injected to the reactor at system temperature.

As shown in FIG. 8, a differential pressure (DP) cell can be used to monitor the liquid levels and control $H_2$ injection and vapor withdrawal.

The distributor tray effluent 138 as a pour point equal to the pour point of the treated feedstock and the collector tray effluent. In view of the fact that olefinic vapor has been removed by interstage separation device 135, distributor tray effleunt 138 is an ideal or optimum feed for introduction to a subsequent catalyst dewaxing bed. The distributor tray effluent is passed through tube weirs 137 to a second dewaxing catalyst bed 150. Dewaxing occurs in catalyst bed 150, as described above, at a temperature range from about 400° to 800° F. (204°–427° C.), preferably about 500° to 675° F. (260°–357° C.), a pressure from about 100 to about 2000 psig (8–139 bars), preferably about 350 to 650 psig (25–46 bars), and a hydrogen feed rate from about 500 to about 10,000 SCF/bbl of distributor tray effluent. The hydrogen is supplied from hydrogen injection means 141 positioned between collector tray 131 and distributor tray 136. Under these conditions, the distributor tray effluent is catalytically dewaxed, which produces a second quantity of vapor 142 of light paraffinic and olefinic fragments having a boiling point of 610° F.− (321° C.−), and a hydrocarbon stock 144 having a further reduced pour point. Where the pour point is of specification (20° F. or less (−7° C.)) hydrocarbon stock 144 can be sent to hydrotreater 180 without removal of the olefinic vapor. If stock 144 is not of specification, it is of optimum quality to be sent to an additional catalyst bed 170 as distributor tray effluent 158.

The second quantity of vapor 142 and the partially reduced pour point feedstock 144 when not of specification can optionally be passed from the second catalyst bed 150 to a second collector tray 151 having at least one downcomer 152. The reduced pour point hydrocarbon stock rises to the level of the downcomer 152 and is passed through the downcomer 152 as collector tray effluent 153. As the reduced pour point hydrocarbon stock is passed to the second collector tray 151, the second quantity of vapor 142 collects in a space 154 positioned between catalyst bed 150 and collector tray 151. Vapor 142 is withdrawn as a vapor stream via vapor removal pipe 155. The withdrawn vapor stream can be merged with other withdrawn vapor streams forming a combined vapor stream 162. Where vapor stream 162 also contains a reduced pour stock, the stream can be sent to the optional separator where stock and gases are separated. Where the removed stock is not of specification, it can be recycled back to the top of the reactor. Where the stock is of specification, it can be recovered and sent to hydrotreater 180 in a manner similar to that described above.

The collector tray effluent 153 is passed to a perforated distributor tray 156 having a plurality of tube weirs 157. The effluent 153 rises to the level of the weirs and is passed through the weirs as distributor tray effluent 158. In a space 159, located between the collector tray 153 and the distributor tray 156, hydrogen-rich gas is injected by means 161 in similar fashion that $H_2$ gas is injected by means 141. Hydrogen gas can be supplied by make-up hydrogen stream 104 or combined stream 104 and 205, forming stream 107. This gas can be heat-exchanged with the withdrawn vapor, as described above. The liquid levels, vapor withdrawal and hydrogen injection can be monitored with DP cells, as described above.

The distributor tray effluent 158 has a pour point equal to the pour point of the reduced pour point feedstock 144 and the collector tray effluent 153. The distributor tray effluent 158 can be passed via the tube weirs 157 to successive catalyst beds and interstage separations, reacting further under conditions described above, to produce a dewaxed stock having a lube pour point of approximately 20° F. (−7° C.) or less. This dewaxed stock is then passed from the reactor 110 to line 168 to the hydrotreater 180 to be upgraded.

Hydrotreater 180 is a conventional hydrotreater and is operated according to methods described for the hydrotreater shown in FIG. 1. The hydrotreater produces hydrotreated effluent stream 184 which passes to a product separation unit 200, and separates the stream 184 into a $C_5^{31}$ stream 201, naphtha stream 202, distillate stream 203, specification lube product 204, and hydrogen recycle stream 205, which passes through recycle compressor 210 and is combined with make-up hydrogen stream 104, forming hydrogen stream 106 or 107.

Figure 9:
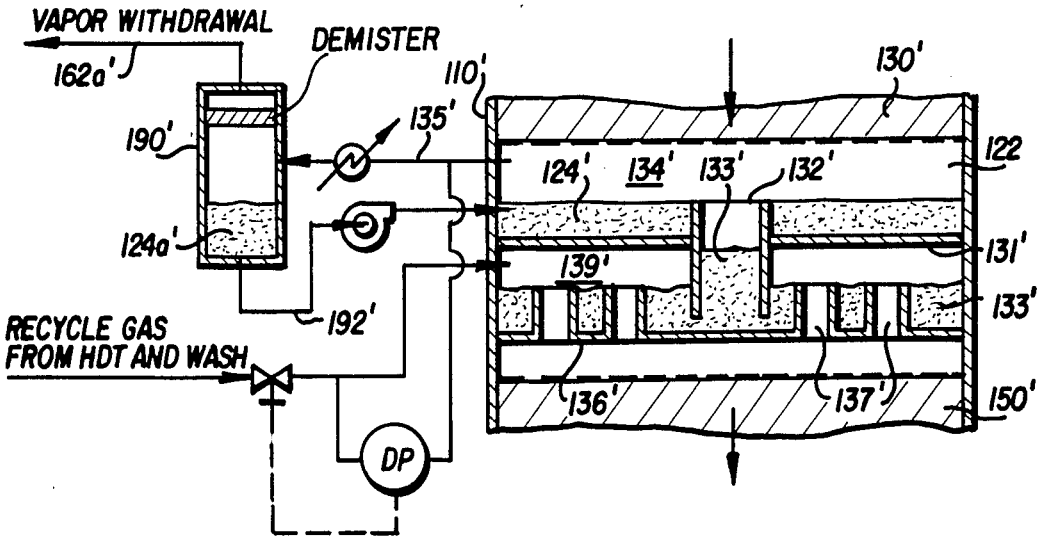
FIG. 9 is an alternative magnified view of a modified portion of the reactor of FIG. 7.

FIG. 9 is an alternative method of removing produced vapor and recycle of removed treated feedstock. Vapor 122' is withdrawn via vapor removal pipe 135'. Vapor 122' may contain a small amount of entrained treated feedstock **124*a*'. The treated feedstock and vapor are charged into separator 190' which has a demister for removing entrained liquid and returning it to the bottom of the separator 190'. The two removed products are separated. Separated olefin-containing vapor 162*a*' can be further processed and the removed treated feedstock 124*a*' if not of specification can be reconveyed via line 192' back to the reactor 110 to liquid treated feedstock 124'. Where liquid 124*a*' is of specification (i.e., a pour point of less than 20° F.), it can be sent to a hydrotreater (not shown). Where the feedstock is of specification, there is no need to remove the olefinic-containing vapor. FIG. 9 also provides a method for injecting hydrogen gas to space 139' between collector tray 131' and distributor 333'**. This method, and the apparatus for performing this method, is similar to that described above, A DP cell is also used to monitor liquid levels, olefin-containing gas removal and hydrogen injection rates.

CATALYSTS

The dewaxing catalysts employed in all the hydrodewaxing reactors 10 and 30, or 110, 150 and 170, may be the same type or different. The reactor may also contain more than one type of dewaxing catalyst. However, the catalyst employed will possess shape-selective paraffin cracking ability. Catalysts that have shape-selective qualities include crystalline zeolite catalysts and crystalline silica alumina phosphate (SAPO) catalysts. These materials may be unbound or bound in a variety of matrices, such as those containing silica and alumina or silica or alumina alone. The catalysts may contain up to 15% metals that are known to possess a hydrogenation ability. The preferred hydrogenation components are the noble metals of Group VIII, especially platinum and palladium, but other noble metals, such as iridium, ruthenium or rhodium, may also be used. Combinations of noble metals with non-noble metals, such as nickel, rhenium, tungsten, chromium and molybdenum may be used. Combinations of Group VIB and Group VIII may also be used. Base metal hydrogenation components may also be used, especially nickel, cobalt, molybdenum, tungsten, copper or zinc.

The metal may be incorporated into the catalyst by any suitable method such as impregnation or exchange onto the zeolite. The metal may be incorporated in the form of a cationic, anionic or a neutral complex, such as $Pt(NH_3)_4^{2+}$, and cationic complexes of this type, will be found convenient for exchanging metals onto a zeolite. Anionic complexes are also useful for impregnating metals into the zeolites.

The invention is effective for improving the hydrodewaxing performance of intermediate pore or large pore zeolites, which are described below, because the invention removes olefinic primary products which are believed to inhibit the hydrodewaxing activity of most hydrodewaxing catalysts.

A portion of the novel class of zeolites useful for hydrodewaxing are termed medium or intermediate pore zeolites and are characterized by an effective pore size of generally less than about 7 Angstroms, and/or pore windows in a crystal formed by 10-membered rings. The medium or intermediate pore zeolites are represented by those zeolites having the structure of ZSM-5, ZSM-11, ZSM-23, ZSM-35, ZSM-38, ZSM-48 and TMA (tetra methyl ammonium) Offretite.

By "intermediate pore size zeolite", as used herein, is meant zeolites having the unique characteristic of being able to differentiate between large molecules and molecules containing quaternary carbon atoms on the one hand, and smaller molecules on the other hand. Thus, the intermediate pore size materials have surprising catalytic activity and stability when compared to most of the larger pore size crystalline zeolites.

By "intermediate pore size", as used herein, is meant an effective pore aperture preferably in the range of about 5 to 6.5 Angstroms when the molecular sieve is in the H-form. Zeolites having pore apertures in this range tend to have unique characteristics and to be particularly useful in dewaxing. Unlike small pore size zeolites, such as erionite and chabazite, they will allow some branched hydrocarbons into the molecular sieve void spaces. Unlike larger pore size zeolites, such as the faujasites, they can differentiate between n-alkanes and slightly branched alkanes on the one hand and larger branched alkanes having, for example, quaternary carbon atoms.

The effective pore size of zeolites can be measured using standard adsorption techniques and compounds of known minimum kinetic diameters. See Breck, *Zeolite Molecular Sieves,* 1974 (especially Chapter 8), and Anderson et al, *J. Catalysis* 58, 114 (1979), both of which are incorporated herein by reference.

Intermediate pore size zeolites in the H-form will typically admit molecules having kinetic diameters of 5.0 to 6.5 Angstroms with little hindrance. Examples of such compounds (and their kinetic diameters in Angstroms) are n-hexane (4.3), 3-methylpentane (5.5), benzene (5.85), and toluene (5.8). Compounds having kinetic diameters of about 6 to 6.5 Angstroms can be admitted into the pores, depending on the particular sieve, but do not penetrate as quickly and, in some cases, are effectively excluded. Compounds having kinetic diameters in the range of 6 to 6.5 Angstroms include: cyclohexane (6.0), 2,3-dimethylbutane (6.1), m-xylene (6.1), and 1,2,3,4-tetramethylbenzene (6.4). Generally, compounds having kinetic diameters of greater than about 6.5 Angstroms do not penetrate the pore apertures, and thus are not absorbed into the interior of the zeolite lattice. Examples of such larger compounds include: hexamethylbenzene (7.1), 1,3,5-trimethylbenzene (7.5), and tributylamine (8.1).

In performing adsorption measurements to determine effective pore size, standard techniques are used. It is convenient to consider a particular molecule as excluded if it does not fill at least 80% of the zeolite pore volume in less than about one hour (p/po=0.5; 25° C.).

The acid activity of zeolite catalysts is conveniently defined by the alpha scale described in an article published in *Journal of Catalysis,* Vol. VI, pp. 278–287 (1966). In this text, the zeolite catalyst is contacted with hexane under conditions prescribed in the publication, and the amount of hexane which is cracked is measured. From this measurement is computed an "alpha" value which characterizes the catalyst for its cracking activity for hexane. The entire article above referred to is incorporated herein by reference. The alpha scale so described will be used herein to define activity levels for cracking n-hexane. And, in particular, for purposes of this invention, a catalyst with an alpha value of not greater than about 1.0, and preferably not greater than about 0.5, will be considered to have substantially no activity for cracking hexane.

Another class of zeolites useful for hydrodewaxing are termed large pore zeolites and have a pore size larger than the medium pore zeolites and sufficiently large to admit the vast majority of components normally found in a feedstock. These zeolites generally are stated to have a pore size in excess of 7.5 Angstroms and/or formed by 12-membered rings. The large pore zeolites are represented by ZSM-4, ZSM-12, ZSM-20, Zeolite Beta, Mordenite, TEA (tetra ethyl ammonium) Mordenite, Dealuminized Y, and Rare Earth Y. Additionally, the large pore component may include a low sodium Ultrastable Y molecular sieve (USY). Generally, with the exception of Zeolite Beta, the large pore zeolites have less hydrodewaxing effectiveness than the intermediate pore zeolites.

ZSM-4 is more particularly described in U.S. Pat. No. 3,923,639.

ZSM-5 is more particularly described in U.S. Pat. Nos. 3,702,886 and Re. 29,948.

ZSM-11 is more particularly described in U.S. Pat. No. 3,709,976.

ZSM-12 is more particularly described in U.S. Pat. No. 3,832,449.

ZSM-20 is more particularly described in U.S. Pat. No. 3,972,983.

ZSM-23 is more particularly described in U.S. Pat. No. 4,076,842.

ZSM-35 is more particularly described in U.S. Pat. No. 4,016,245.

ZSM-38 is more particularly described in U.S. Pat. No. 4,046,859.

ZSM-48 is more particularly described in U.S. Pat. No. 4,397,827.

Zeolite Beta is more particularly described in U.S. Pat. Nos. 3,308,069 and Re. 28,341.

USY is more particularly described in U.S. Pat. Nos. 3,293,192 and 3,449,070.

The oligomerization catalysts preferred for use herein include crystalline alumina silicate zeolites having a silica-to-alumina ratio of at least 12, a Constraint Index of about 1 to 12 and acid cracking activity of about 160–200. Representative of suitable type zeolites are ZSM-5, ZSM-11, ZSM-12, ZSM-23, ZSM-35 and ZSM-38. A suitable shape selective catalyst for a fixed bed reactor is an HZSM-5 zeolite with alumina binder in the form of cylindrical extrudates of about 1–5 millimeters. HZSM-5 is a ZSM-5 type catalyst with only hydrogen on the active catalyst sites and no metals on these sites. Other catalysts which may be used in one or more reactor stages include siliceous materials with pore size in the range of 5 to 9 Angstroms. These include borosilicates, ferrosilicates and/or aluminosilicates, disclosed in U.S. Pat. Nos. 4,414,143 and 4,417,088.

Zeolites characterized by such Constraint Indices induce profound transformation of aliphatic hydrocarbons to aromatic hydrocarbons in commercially desirable yields and are generally highly effective in conversion reactions involving aromatic hydrocarbons. These zeolites retain a degree of crystallinity for long periods in spite of the presence of steam at high temperature, which induces irreversible collapse of the framework or other zeolites, e.g., of the X and A type. Furthermore, carbonaceous deposits, when formed, may be removed by burning at higher than usual temperatures to restore activity. In many environments the zeolites of this class exhibit very low coke forming capability, conducive to very long times on stream between burning regenerations.

An important characteristic of the crystal structure of this class of zeolites is that it provides constrained access to, and egress from, the intracrystalline free space by virtue of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred type zeolites useful in this invention possess a silica-to-alumina mole ratio of at least about 12, for oligomerization and catalytic dewaxing preferably in combination with a structure providing constrained access to the crystalline free space.

The zeolite will have a silica/alumina ratio of at least 12 for oligomerization and dewaxing. The desired low acid activity of the catalyst may be achieved by unusually high silica/alumina ratio, greater than 1000, preferably upwards of about 1500.

The silica-to-alumina ratio referred to may be determined by conventional analysis. This ratio is meant to represent, as closely as possible, the ratio in the rigid anionic framework of the zeolite crystal and to exclude aluminum in the binder or in cationic or other form within the channels. Such zeolites, after activation, acquire an intracrystalline sorption capacity for normal hexane which is greater than that for water, i.e., they exhibit "hydrophobic" properties. It is believed that this hydrophobic character is advantageous in the present invention.

The type zeolites described freely sorb normal hexane and have a pore dimension greater than about 5 Angstroms. In addition, the structure will preferably provide constrained access to larger molecules. It is sometimes possible to judge from a known crystal structure whether such constrained access exists. For example, if the only pore windows in a crystal are formed by 8-membered rings of oxygen atoms, then access by molecules of larger cross-section than normal hexane is excluded and the zeolite is not of the constrained type. Windows of 10-membered rings are preferred, although, in some instances, excessive puckering or pore blockage may render these zeolites ineffective. 12-membered rings do not generally appear to offer sufficient constraint to produce the advantageous conversions for oligomerization, although puckered structures exist, such as TMA offretite, which is a known effective zeolite. Also, structures can be conceived, due to pore blockage or other cause, that may be operative.

Rather than attempt to judge from crystal structure whether or not a zeolite possesses the necessary constrained access, a simple determination of the "Constraint Index" may be made by passing continuously a mixture of an equal weight of normal hexane and 3-methylpentane over a sample of zeolite at atmospheric pressure, according to the following procedure. A sample of the zeolite, in the form of pellets or extrudate, is crushed to a particle size about that of coarse sand and mounted in a glass tube. Prior to testing, the zeolite is treated with a stream of air at 1000° F. for at least 15 minutes. The zeolite is then flushed with helium and the temperature adjusted between 550° and 950° F. to give an overall conversion between 10 and 60%. The mixture of hydrocarbons is passed at 1 liquid hourly space velocity (i.e., 1 volume of liquid hydrocarbon per volume of zeolite per hour) over the zeolite with a helium dilution to give a helium to total hydrocarbon mole ratio of 4:1. After 20 minutes on stream, a sample of the effluent is taken and analyzed, most conveniently by gas chromatography, to determine the fraction remaining unchanged for each of the two hydrocarbons.

The "Constraint Index" is calculated as follows:

$$\text{Constraint Index} = \frac{\log_{10}(\text{fraction of n-hexane remaining})}{\log_{10}(\text{fraction of 3-methyl pentane remaining})}$$

The Constraint Index approximates the ratio of the cracking rate constants for the two hydrocarbons. Preferred zeolites for oligomerization are those having a Constraint Index in the approximate range of 1 to 12. Constraint Index (CI) values for some typical zeolites are:

| Zeolite | CI |
|---|---|
| ZSM-4 | 0.5 |
| ZSM-5 | 8.3 |
| ZSM-11 | 8.7 |
| ZSM-12 | 2 |
| ZSM-35 | 4.5 |
| ZSM-38 | 2 |
| TMA Offretite | 3.7 |
| Beta | 0.6 |
| II-Zeolon | 0.4 |
| REY | 0.4 |
| Amorphous Silica-Alumina | 0.6 |
| Eironite | 38 |

It is to be realized that the above Constraint Index values typically characterize the specified zeolites, but that such are the cumulative result of several variables used in determination and calculation thereof. Thus, for a given zeolite, depending on the temperatures employed within the aforenoted range of 550° to 950° F., with accompanying conversion between 10 and 60% for the above catalyst test, the Constraint Index may vary within the indicated approximate range of 1 to 12. Likewise, other variables, such as the crystal size of the zeolite, the presence of possible occluded contaminants and binders intimately combined with the zeolite, may affect the Constraint Index. It will accordingly be understood by those skilled in the art that the Constraint Index, as utilized herein, while affording a highly useful means for characterizing the zeolites of interest, is approximate, taking into consideration the manner of its determination, with probability, in some instances, of compounding variable extremes.

While the above experimental procedure will enable one to achieve the desired overall conversion of 10 to 60% for most catalyst samples and represents preferred conditions, it may occasionally be necessary to use somewhat more severe conditions for samples for very low acid activity, such as those having a very high silica-to-alumina ratio. In those instances, a temperature of up to about 1000° F. and a liquid hourly space velocity of less than 1, such as 0.1 or less, can be employed in order to achieve a minimum total conversion of about 10% for the above catalyst test.

EXAMPLES

Laboratory tests, described below, were conducted on feedstocks comprising the properties listed in Tables 1 and 3:

TABLE 1

| | Bright Stock |
|---|---|
| API | 26° |
| Specific Gravity | 0.898 |
| Viscosity | |
| KV at 100° C. | 27.36 |
| KV at 300° F. | 8.36 |
| Aniline Point | 248 |
| Elemental Analysis, Wt. % | |
| Carbon | 85.6 |
| Hydrogen | 13.3 |
| Sulfur | 1.1 |
| Nitrogen (ppm) | 68 |
| Paraffins, wt % | 17.8 |
| Mono Naphthenes | 12.7 |
| Poly Naphthenes | 26.5 |
| Aromatics | 43.0 |
| MW | 750 |
| Flash Point | 554° F. |
| Bromine Number | 1.2 |
| Pour Point | 120° F. |
| Distillation | |
| Vol % | °F. |
| IBP | 833 |
| 5 | 939 |
| 10 | 977 |
| 20 | 1016 |
| 30 | 1044 |
| 40 | 1071 |
| 50 | 1097 |
| 60 | 1117 |
| 70 | — |
| 90 | — |
| 95 | — |

TABLE 2

| | | |
|---|---|---|
| Catalyst Particle Diameter, inch | 1/32 | 1/16 |
| Surface Area, $m^2$/gm | 357 | 341 |
| Real Density, gm/cc | 2.61 | 2.60 |
| Particle Density, gm/cc | 0.89 | 1.03 |
| Pore Volume, gm/cc | 0.739 | 0.585 |
| Pore Diameter, Angstroms | 83 | 69 |
| Alpha | 250 | 250 |
| Nickel, Wt % | 1.3 | 0.8 |
| Sodium, ppm | 190 | 190 |

TABLE 3

| | Light Neutral Stock |
|---|---|
| API | 30.6 |
| Specific Gravity | 0.873 |
| Viscosity | |
| KV at 100° C. | 5.558 |
| KV at 300° F. | 2.45 |
| KV at 40° C. | 30.61 |
| Aniline Point | 215 |

TABLE 3-continued

| | Light Neutral Stock |
|---|---|
| Elemental Analysis, Wt. % | |
| Carbon | 85.4 |
| Hydrogen | 14.0 |
| Sulfur | 0.6 |
| Nitrogen (ppm) | 45 |
| Paraffins, wt % | 38.8 |
| Mono Naphthenes | 13.8 |
| Poly Naphthenes | 22.0 |
| Aromatics | 25.4 |
| MW | 480 |
| Flash Point | 428° F. |
| Bromine Number | 1.0 |
| Pour Point | 95° F. |
| Distillation | |
| Vol % | °F. |
| IBP | 745 |
| 5 | 792 |
| 20 | 818 |
| 30 | 826 |
| 40 | 836 |
| 50 | 844 |
| 60 | 853 |
| 70 | 865 |
| 80 | 879 |
| 90 | 899 |
| 95 | 912 |
| End Point | 942 |

TABLE 4

Vapor-Liquid Equilibrium During Dewaxing a Light Neutral Lube (400 psig, 1.0 LHSV over NiZSM-5)

| | | | | | |
|---|---|---|---|---|---|
| Pour, °F. (600° F.+) | | 35 | | 35 | |
| Dewaxing Reactor Temp. °F. | | 550 | | 670 | |
| | Total | Liquid | Vapor | Liquid | Vapor |
| Process Yields, Wt % | | | | | |
| $C_1$-$C_4$ (gases) | 4.76 | 0.16 | 4.60 | 0.12 | 4.64 |
| $C_5$-400° F. (naphtha) | 11.96 | 1.18 | 10.78 | 0.73 | 11.23 |
| 400°-600° F. (distillate) | 0.27 | 0.11 | 0.16 | 0.06 | 0.21 |
| 600° F.+ (lube) | 83.01 | 82.05 | 0.96 | 76.63 | 6.38 |
| | 100.00 | | | | |
| Separation Efficiency $C_1$-600° F. (non-lube), % | | 8.5 | 91.5 | 5.5 | 94.5 |
| Pour, °F. (600° F.+) | | 5 | | 5 | |
| Dewaxing Reactor Temp., °F. | | 550 | | 670 | |
| | Total | Liquid | Vapor | Liquid | Vapor |
| Process Yields, Wt % | | | | | |
| $C_1$-$C_4$ (gases) | 4.93 | 0.16 | 4.77 | 0.13 | 4.80 |
| $C_5$-400° F. (naphtha) | 12.13 | 1.23 | 10.90 | 0.75 | 11.38 |
| 400°-600° F. (distillate) | 0.22 | 0.09 | 0.13 | 0.05 | 0.17 |
| 600° F.+ (lube) | 82.72 | 81.80 | 0.92 | 76.29 | 6.43 |
| | 100.00 | | | | |
| Separation Efficiency $C_1$-600° F. (non-lube), % | | 8.5 | 91.5 | 5.5 | 94.5 |

EXAMPLE 1

Example 1 provides pilot plant data showing the inhibiting effect of olefins upon catalytic dewaxing activity and illustrates the importance of removing the olefins to enhance catalytic dewaxing by embodiments such as those illustrated in FIGS. 1, 2 and 7. The tests were conducted in a 12" long, $\frac{7}{8}$" side diameter reactor, with a 100 cc volume to simulate a first reactor 10 at a pressure of 400 psig and a hydrogen feed rate of 2500 SCF/bbl using a bright stock, described by Table 1, as a feedstock to produce a first effluent stream, olefin-containing gas, and reduced pour point oil.

The feedstock was contacted with a 1/32" Ni-ZSM-5 unsteamed extrudate for MLDW (Mobil Lube Dewaxing) catalyst. The catalyst was prepared from a base of 65% ZSM-5 type zeolite mixed with 35% hydrated alumina (alpha alumina monohydrate). The base was then dried and calcined in $N_2$ at 1000° F. to decompose organic material. Then, the base was exchanged at room temperature with an aqueous solution of ammonium nitrate ($NH_4NO_3$) to reduce sodium levels in the zeolite to less than 500 ppm. This reduced sodium material was impregnated with nickel components by contact with an aqueous solution of nickel nitrate ($Ni(NO_3)_2.6H_2O$). The resulting composite was dried out and calcined at 1000° F. and the final product contained about 1.3 wt % nickel. The catalyst properties are listed in Table 2.

To start up the test reactor, the catalyst was sulfided with $H_2S$ from 450° to 650° F. The reactor was then lined out at 400° F. and then the catalyst was contacted with feedstock. Then, the temperature was raised in 10° F./hr (6° C./hr) increments until a 20° F. pour point effluent was produced. Afterwards, temperature was adjusted to maintain the 20° F. pour point specification. FIG. 3 plots the pour point of the first effluent stream, average reactor temperature (°F.), and LHSV versus days on stream. After lining out the bright stock to produce an effluent 12 with 10° to 15° F. pour point, 15% 1-decane was co-fed with the bright stock as feedstock 2. The effluent 12 pour point increased drastically.

EXAMPLE 2

Example 2 was designed to show that the majority of the olefins are removed from a stream, such as the first reactor effluent stream 12, by separating a vapor stream employing a separating unit, such as the first separating unit 20. The tests were conducted in the same type test reactor disclosed in Example 1 and employed the feedstock disclosed in Table 3. The feedstock was contacted with a 1/16" Ni-ZSM-5 unsteamed extrudate MLDW catalyst. The 1/16" catalyst was prepared in a similar manner as was the 1/32" catalyst of Example 1 and had the properties listed by Table 2. Prior to use in this example, the catalyst was employed in a commercial operation and then regenerated by oxidation to remove coke. The regenerated catalyst was placed into the test reactor of the present example and run with a bright stock and then the stock was switched to the light neutral stock of Table 3. The test reactor was then lined out at 655° F. and held constant for the balance of these tests. It is not believed that the prior runs of the catalyst interfere with the validity of the test results for this example, because the catalyst had been regenerated by oxidation before dewaxing bright stock and any loss in catalyst activity is accounted for by the reactor temperature and space velocities selected for this Example.

The test reactor represented the hydrodewaxing reactor 10 and was operated at a pressure of 400 psig, a hydrogen feed rate of 2500 SCF/bbl of product, and a range of LHSV from 0.5 to 0.4. FIG. 4 shows the olefinic contents of the various product cuts obtained from distilling the first effluent stream 12, plotted versus 1/LHSV of the test reactor. Comparing the olefinic contents of the total liquid product and lube fraction clearly indicates that almost all of the olefinic products occurred in the distillate (330° to 610° F.) and lighter fractions.

FIG. 5 shows the results of a commercial adiabatic reactor simulation and demonstrates the occurrence of a reactor temperature runaway in case of an operating upset, such as flow non-uniformity, when the dewaxing operation employs no separating units 20 and 60 of FIG. 2, or vapor withdrawal means, such as means 135 and 155 of FIG. 7. This simulation shows the temperature runaways which can occur if primary vapor by-products are not separated from a catalytic hydrodewaxing reactor effluent. The simulation conditions included a pressure of 400 psig, a LHSV of 1 $hr^{-1}$ and a hydrogen feed rate of 2500 SCF/bbl and the feedstock 2 was a typical light neutral stock having the properties described by Table 3. The simulation represents a feedstock 2 flowing through a single adiabatic reactor, with no vapor separation, to produce a 20° F. pour point lube product 32 of FIG. 2 and 20° F. pour lube product in stream 184 of FIG. 7. The simulation divided the reactor into an outer annulus zone and a central zone, as shown in FIG. 5. The annulus zone has the same cross-sectional area as the central zone. The simulation assumes that only 20% of the oil throughput flows through the outer annulus zone, while 80% flows through the central zone.

FIG. 5 shows the effect of gas/liquid phase maldistribution and olefinic by-products. The reactions, namely endothermic cracking of wax to primary by-products, which include light olefins, and exothermic hydrogenation of the olefins, take time to develop but maldistribution is throughout. Thus, as the throughput proceeds along the fractional bed length of the reactor the reactions progress, causing the temperature differential between the annulus zone and the central zone to become more and more extreme. It would be more desirable to achieve the gradual temperature rise of perfect mixing, as simulated by the dashed line in FIG. 5 representing a well distributed flow. Hydrogenation of the olefinic products in the annulus zone can lead to a temperature rise of 135° F. when the majority of the oil phase flows through the central zone and a majority of the gas phase flows through the annulus zone. This large temperature rise would decrease the lube yield and degrade the lube product.

EXAMPLE 3

Example 3 was designed to show that under typical dewaxing reaction conditions 90% of the non-lube reaction products are in the vapor phase. The results are reported in Table 4.

A light neutral lube boiling above 600° F. (316° C.) and having a pour point of 35° C. is subjected to catalytic dewaxing over a NiZSM-5 type catalyst in a test reactor at pressure of 400 psig and a LHSV of 1.0. Flash calculations were conducted for this lube. A first set of calculations was obtained at a start of cycle temperature of 550° F. (288° C.) and a pressure of 400 psig (28.6 bar absolute). A second set of calculations was obtained at an end of cycle temperature of 670° F. (354° C.) at a pressure of 400 psig (28.6 bar absolute).

From Table 4, it is seen that greater than 90% of the non-lube reaction products are in the vapor phase.

A second product boiling above 600° F. (316° C.), having a pour point of 5° F. (−15° C.), is subjected to catalytic dewaxing over a NiZSM-5 type catalyst in a test reactor at pressure of 400 psig and a LHSV of 1.0. Flash calculations were conducted for this lube. A third set of calculations was obtained at a start of cycle temperature of 550° F. (287° C.) and at a pressure of 400 psig. A fourth set of calculations was obtained at an end of cycle temperature of 670° F. (354° C.) at a pressure of 400 psig.

Again, from Table 4, it is seen that the greater than 90% of the non-lube products are in the vapor phase.

In catalytic dewaxing a lube product over the temperature range of about 500° to 675° F., the production of non-lube vapor products, if not removed, will seriously affect the reaction conditions and the length of cycle of the dewaxing reactor.

EXAMPLE 4

Figure 6:
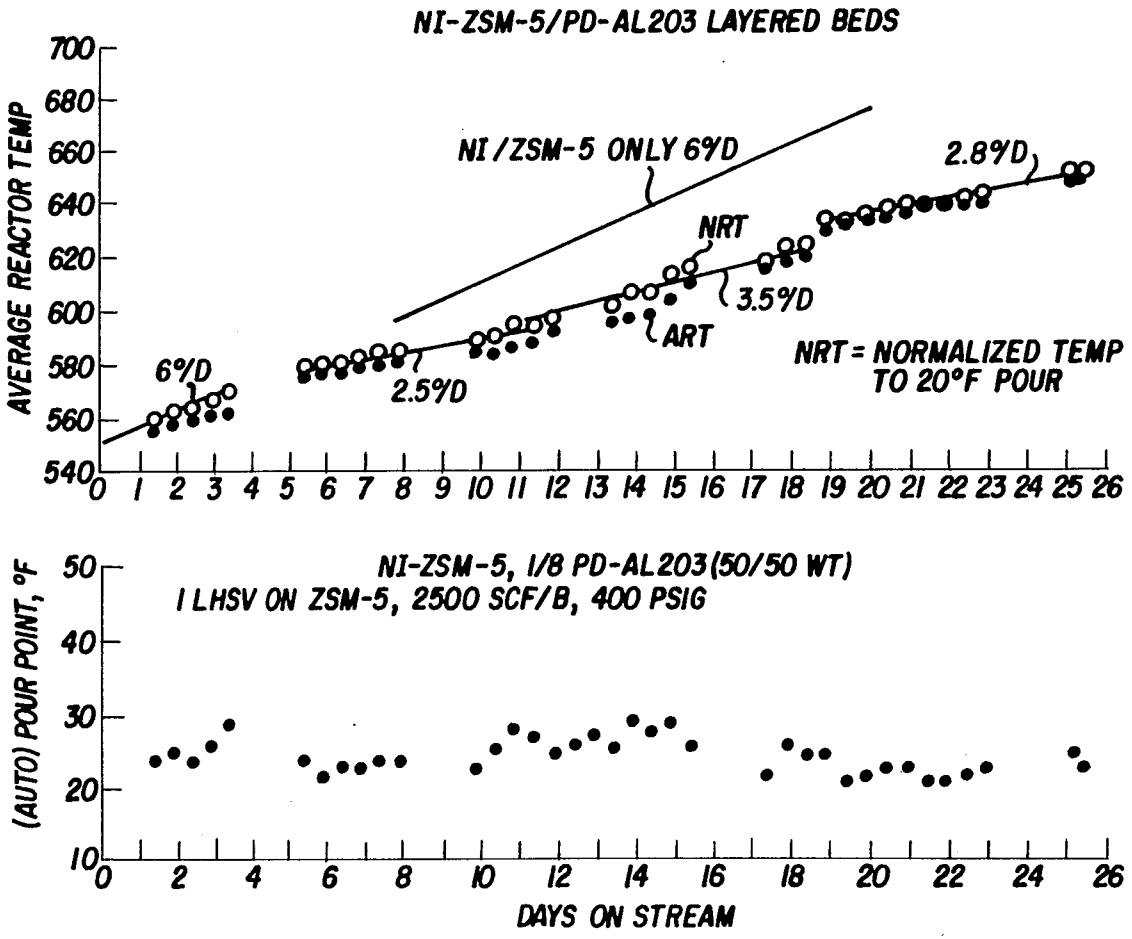
FIG. 6 shows the benefit of a much smaller aging rate of a catalyst in a pilot-plant layered bed reactor having alternate layers of dewaxing and hydrotreating catalysts.

FIG. 6 shows the benefit of hydrogenating the olefins which are produced in a pilot plant reactor having a layered bed of alternating layers of a dewaxing catalyst, Ni/ZSM-5 and a hydrogenating catalyst $Pd/Al_2O_3$. The aging rate of dewaxing a heavy neutral stock under standard reaction conditions to a pour point of 20° F. (−7° C.) was reduced by a factor of 2 relative to conventional reactors run at standard conditions, without the benefit of olefin removal.

EXAMPLE 5

In a process variable study, propylene was passed over a catalyst extrudate of HZSM-5 at 525° F., and at olefin partial pressures of 1.3 and 14.7 psia, and a weight hourly space velocity of 0.2 to 20. From FIGS. 10 and 11, it is shown that for short residence times, only trace amounts of $C_6$–$C_{11}$ aromatics were formed. The formation of these products, as shown, increases with increased residence time. At the longest residence time (0.2 WHSV), aromatics amounted to 10 to 20 wt % of the total product.

This example serves to point to the fact that the failure to remove olefins leads to the formation of unwanted aromatic products.

EXAMPLE 6

Toluene extracted from coked Ni/ZSM-5 extrudate used in processing of $C_6$–$C_8$ normal paraffin and aromatics, and in a separate run of $C_6$ to 625° F. light neutral raffinate at 600° to 650° F. and 400 psig, was analyzed by high mass spectrometry. The extracts were found to contain $C_{16}$–$C_{21}$ mono-, di-, tri-, tetra- and penta-aromatics. Naphthene benzenes and dinaphthene benzenes were also detected.

This example serves to point to the fact that high molecular weight aromatic mixtures are produced at end-of-cycle temperature in a dewaxing reactor. The formation of such products serves to deactivate the dewaxing catalyst.

Hydrodewaxing hydrocarbons using reactors with intermediate separation of light products containing olefins, removes the olefinic products as they are formed during the course of the hydrodewaxing reaction, preventing the formation of aromatic products. This simultaneously enhances the hydrodewaxing catalyst activity and controls reactor behavior. The enhanced catalyst activity results in a lower start-of-cycle temperature and a larger operating temperature span, thus resulting in a longer catalyst cycle life. The method and apparatus of FIG. 1 allows for a continuous process which takes advantage of all the benefits of two-stage dewaxing. The embodiment of FIG. 2 removes these olefinic products as they are formed during the course of the dewaxing reaction, as in the first embodiment, and routes them through an MOGDL unit to convert them into additional low pour high quality lube. This simultaneously enhances the dewaxing catalyst activity, increases the lube yield and insures a controlled reactor behavior. Furthermore, blending of the low pour MOGDL lube into the main lube product stream would reduce the requirement of dewaxing severity to meet a given target pour point. The final embodiment of FIG. 7 provides a process and apparatus wherein a single dewaxing reactor is used in combination with spaced catalyst beds, and means for olefin removal between the beds to dewax a hydrocarbon feedstock. This embodiment leads to savings of capital costs and system retrofitting is made easier.

While specific embodiments of the method and apparatus aspects of the invention have been shown and described, it should be apparent that many modifications can be made thereto without departing from the spirit and scope of the invention. Accordingly, the invention is not limited by the foregoing description, but is only limited by the scope of the claims appended thereto.

We claim:

1. A method for hydrodewaxing a hydrocarbon feedstock comprising the steps of:

(a) passing said hydrocarbon feedstock and hydrogen gas through a dewaxing reactor containing a series of adjacent dewaxing catalyst beds to produce a dewaxed feedstock and olefin-containing vapor, wherein each of said catalyst beds is separated by a collector tray and a distributor tray positioned below said collector tray;

(b) withdrawing said olefin-containing vapors above each said collector tray; and (c) injecting non-olefinic hydrogen-rich gas between each said collector tray and each said distributor tray to produce an optimum feed to the succeeding dewaxing catalyst bed.

2. The method according to claim 1, wherein said dewaxing catalyst has a ZSM-5 structure.

3. The method according to claim 2, wherein said dewaxing catalyst further comprises a Ni or Pd component.

4. A method for hydrodewaxing a hydrocarbon feedstock comprising the steps of:

(a) passing said hydrocarbon feedstock and hydrogen gas through an inlet of a hydrodewaxing reactor over a first dewaxing catalyst bed, contained in said reactor, to produce a first dewaxed liquid feedstock and a first quantity of olefin-containing vapor;

(b) passing said first dewaxed liquid feedstock to a first collector tray, and withdrawing said first quantity of olefin-containing vapor and a quantity of said first dewaxed liquid feedstock from a space between said first catalyst bed and said collector tray to produce a first collector tray liquid effluent;

(c) passing said first collector tray liquid effluent to a first distributor tray and injecting non-olefinic hydrogen-rich gas into a space between said first collector tray and said first ditributor tray to produce a first distributor tray effluent; and (d) passing said first distributor tray effluent over a second dewaxing catalyst bed to produce a hydrocarbon stock having a reduced pour point and a second quantity of olefin-containing vapor.

5. The method according to claim 4, further comprising passing said hydrocarbon stock to a hydrotreating reactor containing a hydrotreating catalyst to produce a hydrotreated effluent stream and recovering said hydrotreated effluent stream as a lube product.

6. The method according to claim 4, wherein said dewaxing catalyst has a ZSM-5 structure.

7. The method according to claim 6, wherein said dewaxing catalyst further comprises a Ni or Pd component.

8. The method according to claim 4, which comprises further dewaxing said hydrocarbon stock by, passing said hydrocarbon stock to a second collector tray and withdrawing said second quantity of vapor to produce a second collector tray liquid effluent;

passing said second collector tray liquid effluent to a second distributor tray and injecting non-olefinic hydrogen-rich gas into a space between said second collector tray and said second distributor tray to produce a second distributor tray effluent; and passing said second distributor tray effluent over a third dewaxing catalyst bed to produce a second hydrocarbon stock having a reduced pour point and a third quantity of olefinic vapor.

9. The method according to claim 4, further comprising recovering said withdrawn quantity of dewaxed feedstock as a lube product and hydrotreating said lube product.

10. The method according to claim 4, further comprising:

hydrodewaxing said feedstock and said first distributor tray effluent at a temperature in the range from about 400° to 800° F., a pressure in the range from about 100 to about 2000 psig and a hydrogen feed rate in the range from about 500 to about 10,000 SCF/bbl of said feedstock; and wherein the overall space velocity for said feedstock hydrodewaxing step and said first distributor tray hydrodewaxing step is from about 0.25 to about 4.0 $hr^{-1}$ LHSV.

11. The method according to claim 4, wherein said first quantity of olefin-containing vapor comprises hydrocarbons having a boiling point of 610° F. or less, and said first dewaxed liquid feedstock comprises hydrocarbons having an initial boiling point ranging from 610° to 800° F.

12. The method according to claim 5, wherein said hydrotreating catalyst is selected from the group consisting of $Pd/Al_2O_3$ and $CoMo/Al_2O_3$.

13. The method according to claim 10, wherein said first dewaxed liquid feedstock has a pour point of about 50° to about 70° F. and said hydrocarbon stock has a reduced pour point of less than about 20° F.

14. The method according to claim 13, wherein said dewaxing catalyst has a structure of at least one zeolite selected from the group consisting of ZSM-5, ZSM-11, ZSM-23, ZSM-35, ZSM-38, ZSM-48 and TMA Offretite.

15. The method according to claim 13, wherein said dewaxing catalyst has a structure of Zeolite Beta.

16. The method according to claim 4, further comprising the step of catalytically oligomerizing said withdrawn olefin-containing vapor to produce lube range hydrocarbons.

17. The method according to claim 16, wherein said oligomerization occurs at a temperature from about 350° F. to about 600° F., a pressure from about 100 psig to about 3000 psig and a space velocity from about 0.1 to about 5.0 $hr^{-1}$ LHSV.

18. The method according to claim 10, wherein said hydrocarbon feedstock is a heavy distillate having an end point of at least 610° F.

19. A method of hydrodewaxing a hydrocarbon feedstock comprising the steps of:

(a) passing said hydrocarbon feestock and hydrogen gas through the inlet of a hydrodewaxing reactor, over a first catalyst bed contained therein, wherein the reactor has a temperature in the range from about 500° to 675° F., and a pressure from about 350 to 650 psig, and hydrogen is introduced above said catalyst bed at a feed rate from about 1500 to about 4000 SCF/bbl of said feedstock, to produce a first quantity of olefinic vapor and a first dewaxed liquid feedstock having an intermediate pour point;

(b) passing said first dewaxed liquid feestock to a first collector tray, positioned below said first catalyst bed, and withdrawing said first quantity of olefinic vapor from a space between said first catalyst bed and said first collector tray to produce a first collector tray liquid effluent;

(c) passing said first collector tray liquid effluent to a first distributor tray and injecting non-olefinic hydrogen-rich gas into a space between said first collector tray and said first distributor tray, at a rate of from about 1500 to 4000 SCF/bbl of said feedstock, to produce a first distributor tray effluent;

(d) passing said first distributor tray effluent over a second catalyst bed containing at least one layer of a dewaxing catalyst at a temperature in the range from about 500° to 675° F., and a pressure from about 350 to 650 psig to produce a hydrocarbon stock having a reduced pour point of between 0° and 20° F. and a second quantity of olefinic vapor; and (e) passing said hydrocarbon stock to a hydrotreating reactor containing a hydrotreating catalyst to produce a hydrotreated effluent stream and recovering said hydrotreated effluent stream as a lube product.

20. The method according to claim 19 which further comprises:

passing said hydrocarbon stock having a reduced pour point of between 0° and 20° F. to a second collector tray and withdrawing said second quantity of vapor to produce a second collector tray liquid effluent;

passing said second collector tray liquid effluent to a first distributor tray and injecting non-olefinic hydrogen-rich gas into a space between said second collector tray and said second distributor tray, at a rate of from about 1500 to 400 SCF/bbl of said feedstock to produce a second distributor tray effluent; and passing said second distributor tray effluent over a third dewaxing catalyst bed at a temperature in the range from about 500° to 675° C., and a pressure from about 350 to 650 psig to produce a hydrocarbon stock having a pour point of about 0° and a third quantity of olefinic vapor.

* * * * *